US009931554B2

(12) United States Patent
Marquez et al.

(10) Patent No.: US 9,931,554 B2
(45) Date of Patent: Apr. 3, 2018

(54) GOLF BAG BASE ASSEMBLY

(71) Applicant: Callaway Golf Company, Carlsbad, CA (US)

(72) Inventors: Alfredo M. Marquez, Rancho Santa Margarita, CA (US); Derek D. Hanzek, San Diego, CA (US); Jaclyn T. Sonico, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 170 days.

(21) Appl. No.: 15/197,319

(22) Filed: Jun. 29, 2016

(65) Prior Publication Data

US 2017/0043225 A1 Feb. 16, 2017

Related U.S. Application Data

(60) Provisional application No. 62/205,413, filed on Aug. 14, 2015.

(51) Int. Cl.

| | |
|---|---|
| ***A63B 55/00*** | (2015.01) |
| ***A63B 55/50*** | (2015.01) |
| *A63B 71/06* | (2006.01) |

(52) U.S. Cl.

CPC ..... *A63B 55/50* (2015.10); *A63B 2071/0625* (2013.01)

(58) Field of Classification Search

CPC ..... A63B 55/50; A63B 2071/0625

See application file for complete search history.

(56) References Cited

U.S. PATENT DOCUMENTS

| | | | | | |
|---|---|---|---|---|---|
| 1,438,263 | A * | 12/1922 | Rothschild | A63B 55/00 | 206/315.8 |
| 2,045,147 | A * | 6/1936 | Johnson | A63B 55/50 | 206/315.6 |
| 4,378,039 | A * | 3/1983 | Suk | A63B 55/00 | 206/315.8 |
| 5,445,267 | A * | 8/1995 | Biafore, Jr. | A63B 55/00 | 206/315.3 |
| 5,638,954 | A * | 6/1997 | Hsien | A63B 55/00 | 206/315.3 |
| 5,725,095 | A * | 3/1998 | Beck | A63B 55/00 | 206/315.3 |
| 5,769,220 | A * | 6/1998 | Hong | A63B 55/00 | 206/315.3 |
| 5,772,024 | A * | 6/1998 | Lueders | A63B 55/00 | 206/315.3 |
| 5,788,071 | A * | 8/1998 | Shiao | A63B 55/00 | 206/315.3 |
| 8,141,705 | B2 * | 3/2012 | Aubery | A63B 55/00 | 206/315.3 |

(Continued)

*Primary Examiner* — Tri Mai

(74) *Attorney, Agent, or Firm* — Rebecca Hanovice; Michael Catania; Sonia Lari

(57) ABSTRACT

A golf bag base assembly with snap features is disclosed herein. The assembly preferably comprises a base with pin holes extending through a bottom surface, a retaining ring with locking pin receptacles at locations designed to line up with the pin holes, and a plurality of locking pins with compressible slotted ends that engage corresponding pin holes and locking pin receptacles to securely attach the base to the retaining ring. The retaining ring may be attached to other golf bag parts, including a body, a top collar, and dividers.

20 Claims, 5 Drawing Sheets

(56) References Cited

U.S. PATENT DOCUMENTS

| | | | | |
|---|---|---|---|---|
| 9,827,471 | B1 * | 11/2017 | Wang | A63B 55/57 |
| 2014/0034527 | A1 * | 2/2014 | Anderson | A63B 55/00 206/315.6 |
| 2014/0353437 | A1 * | 12/2014 | Tan | A63B 55/04 248/96 |

* cited by examiner

GOLF BAG BASE ASSEMBLY

CROSS REFERENCES TO RELATED APPLICATIONS

The present application claims priority to U.S. Provisional Patent Application No. 62/205,413, filed on Aug. 14, 2015, the disclosure of which is hereby incorporated by reference in its entirety herein.

STATEMENT REGARDING FEDERALLY SPONSORED RESEARCH OR DEVELOPMENT

Not applicable

BACKGROUND OF THE INVENTION

Field of the Invention

The present invention relates to a golf bag comprising a locking pin assembly that facilitates simple, fast, and secure assembly of the bag base.

Description of the Related Art

Golf bags of all kinds, including stand and cart bags, typically are assembled from a base, a top with multiple openings, and a body with structural support that connects the base and the top. The prior art includes certain golf bag products with locking mechanisms integrated with the base and/or top portions and that include "snap" mechanisms, such as those disclosed in U.S. Patent Application Publication Number 2014/0034527 to Anderson. These prior art mechanisms are not ideal, however, because during assembly the snap assembly is invisible to the operator, who has no confirmation that the locking mechanism has engaged with other parts of the bag. In order to address this concern, prior art systems often incorporate extra snap features in the top or the base, which increases the difficulty of assembling the bag as well as its overall weight. Therefore, there is a need for an improved assembly mechanism for golf bags, and bases in particular.

BRIEF SUMMARY OF THE INVENTION

The golf bag bases of the present invention are easily assembled from their component parts via a locking pin and receptacle mechanism, which provide visible and audible alignment during assembly.

One aspect of the present invention is a golf bag comprising a body comprising a ring with a plurality of pin receptacles, each of the plurality of pin receptacles having a first bore and a second bore wherein a diameter of the second bore is larger than a diameter of the first bore, a base comprising a plurality of pin through holes, and a plurality of locking pins, each of the plurality of locking pins comprising a foundation section having a first diameter, an extension section having a second diameter, a slotted section having a third diameter, and a crown section having a fourth diameter, wherein the slotted section is compressible, wherein the first diameter is greater than the second diameter, wherein the second diameter is greater than the third diameter, wherein the fourth diameter is greater than the third diameter, wherein the first diameter is larger than a diameter of the plurality of pin through holes, wherein each of the plurality of locking pins is positioned through a corresponding pin through hole and a corresponding pin receptacle, wherein the slotted section of each of the plurality of locking pins expands once positioned within the corresponding pin receptacle to lock each of the plurality of locking pins in place and secure the base to the body. The ring may comprise a plurality of stay receptacles, and the plurality of locking pins may range from two to ten.

In some embodiments, each of the plurality of locking pins may have from two to six slots in the slotted section, and each of the plurality of locking pins may have a length ranging from two inches to six inches. In other embodiments, the first diameter may range from 0.1 inch to 0.5 inch. Each of the plurality of pin through holes may further comprise a cylindrical body, which may cover more than 50%, or even 75%, of the extension section when a locking pin is engaged with the cylindrical body. In other embodiments, the fourth diameter may be the diameter of the crown section at a lowest edge, the crown section may comprise a fifth diameter at an upper edge of the crown section, and the fourth diameter may be greater than the fifth diameter. In a further embodiment, the crown section may decrease gradually in diameter from the fourth diameter to the fifth diameter. The golf bag may further comprise a top collar and a plurality of stays, the ring may comprise a plurality of stay receptacles, each stay may comprise a first end and a second end, each of the plurality of stay receptacles may be engaged with a first end, and the top collar may engage each second end. In a further embodiment, each of the plurality of stays may be permanently engaged with each of the top collar and the ring, and none of the plurality of stays may make contact with the base.

Another aspect of the present invention is a golf bag base assembly comprising a ring comprising a plurality of pin receptacles and a plurality of stay receptacles, each of the plurality of pin receptacles having a first bore and a second bore, wherein a diameter of the second bore is larger than a diameter of the first bore, a base comprising a base surface, a side wall, and a plurality of pin through holes, and a plurality of locking pins, each locking pin comprising a foundation section, an extension section, a compressible slotted section, and a tapered crown section, wherein each of the plurality of pin through holes extends through the base surface and comprises a cylindrical body, wherein each of the plurality of locking pins is positioned through a corresponding pin through hole and a corresponding pin receptacle, wherein the slotted section of each of the plurality of locking pins expands once positioned within the corresponding pin receptacle to lock each of the plurality of locking pins in place and secure the base to the ring, and wherein each cylindrical body covers more than 50% of the extension section when a locking pin is engaged with the corresponding cylindrical body. In a further embodiment, each cylindrical body may cover more than 75% of the extension section when a locking pin is engaged with the corresponding cylindrical body.

In other embodiments, the base surface may comprise an edge region proximate the side wall, and each of the plurality of pin through holes may be located in the edge region. In another embodiment, the compressible slotted section of each locking pin may comprise at least two slots and at least four prongs, and the plurality of locking pins may range from two to ten. In another embodiment, each of the plurality of locking pins may have a length ranging from two inches to six inches.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
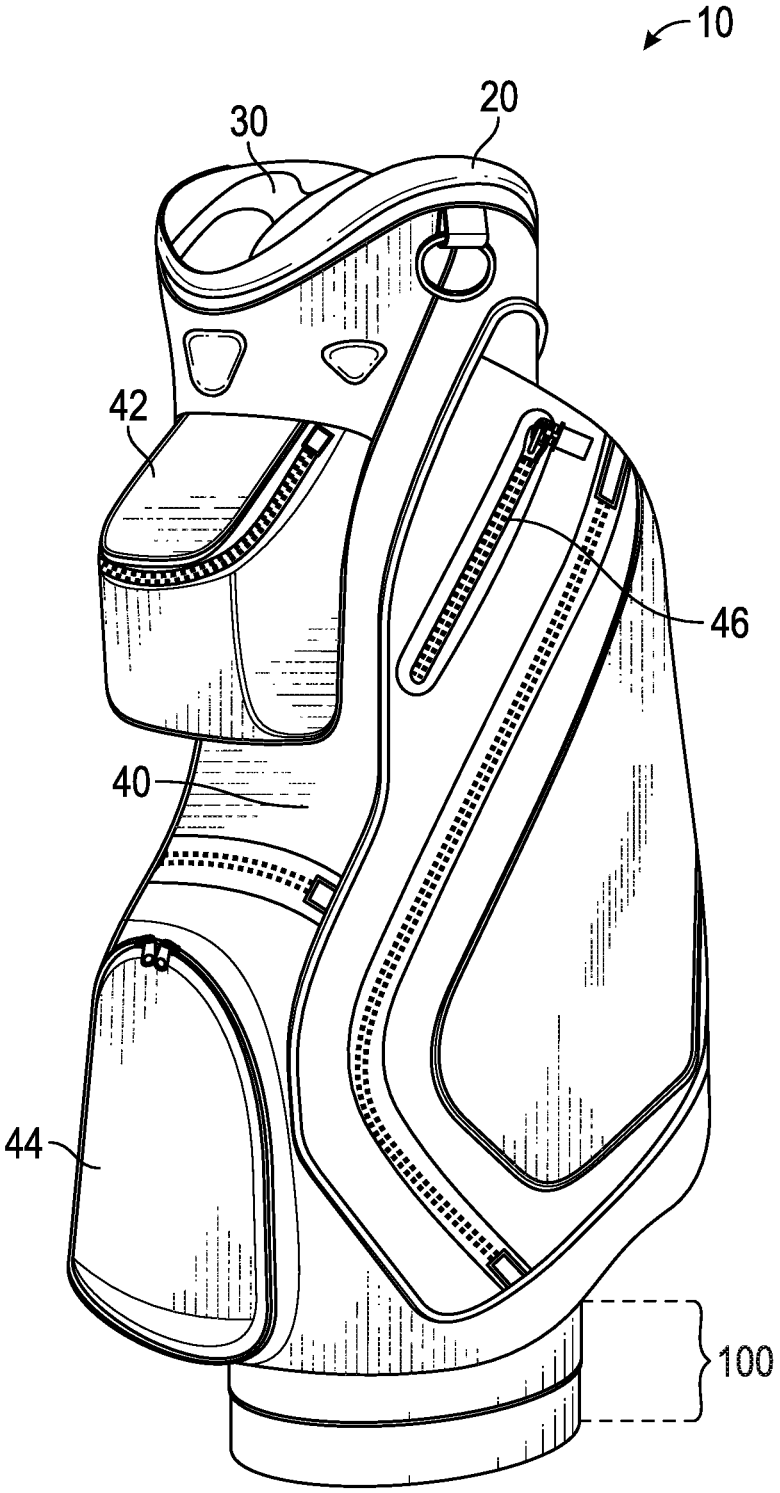
FIG. 1 is a side elevation view of a golf bag of the present invention.
Figure 2:
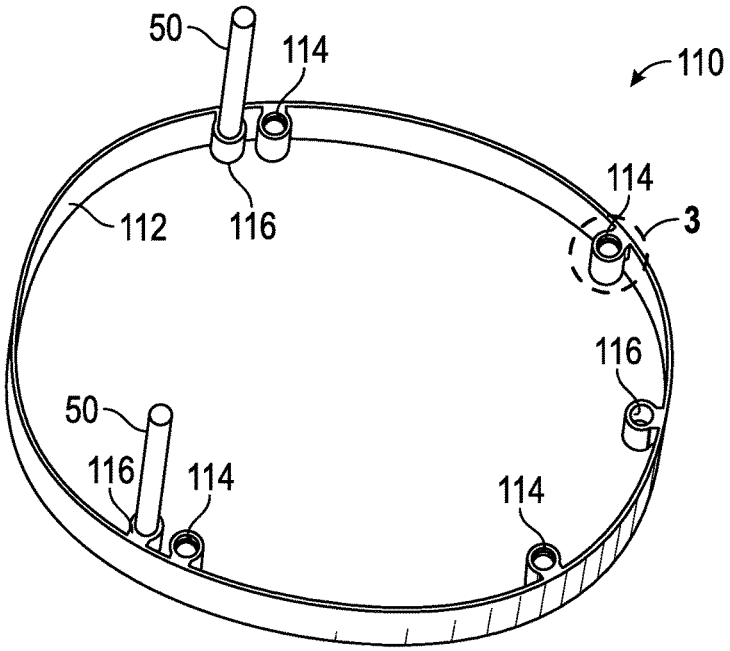
FIG. 2 is a top perspective view of a retention ring portion of the golf bag shown in FIG. 1.
Figure 3:
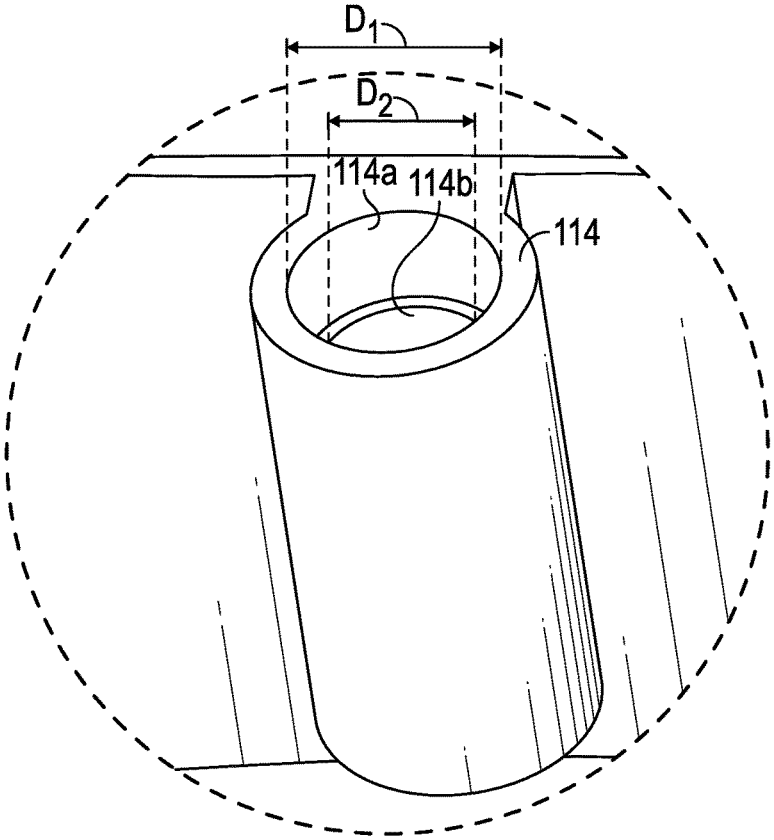
FIG. 3 is an enlarged, perspective view of the pin receptacle circled in FIG. 2.

A preferred embodiment of the present invention is shown in FIGS. 1-10. The golf bag 10 of the present invention includes a top collar 20 with dividers 30, a body 40 comprising a plurality of pockets 42, 44, 46, and a base assembly 100. The base assembly includes a retainer ring 110, shown in FIG. 2, which comprises a wall 112, a plurality of pin lock receptacles 114, and a plurality of stay receptacles 116. The stay receptacles 116 are sized to receive long, cylindrical stays 50 that provide the structural support for the body 40 of the golf bag 10 and connect the base assembly 100 with the top collar 20. Examples of such stays can be found in, for example, U.S. Patent Application Publication Number 2015/0122678, the disclosure of which is hereby incorporated by reference in its entirety herein. The pin lock receptacles 114 are cylindrical through bores with an upper bore 114*a* having a first diameter $D_1$ and a lower bore 114*b* having a second, smaller diameter $D_2$.

Figure 4:
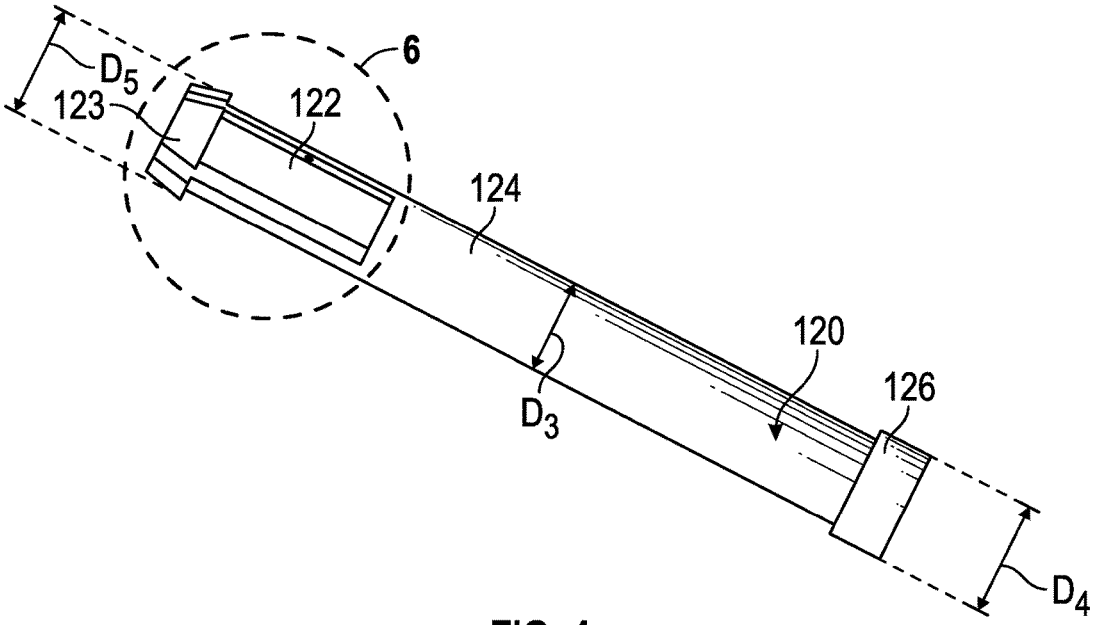
FIG. 4 is a side perspective view of a lock pin of the present invention.
Figure 5:
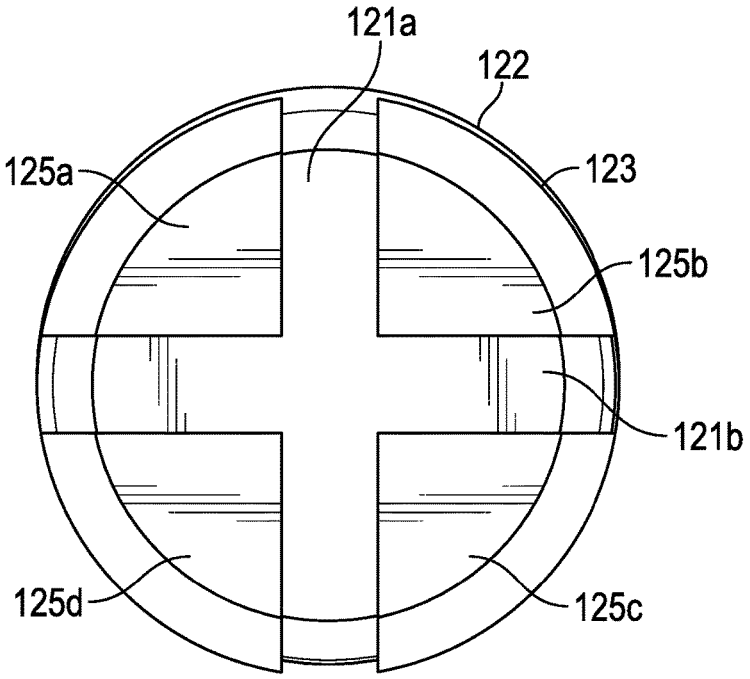
FIG. 5 is atop, plan view of the lock pin shown in FIG. 4.
Figure 6:
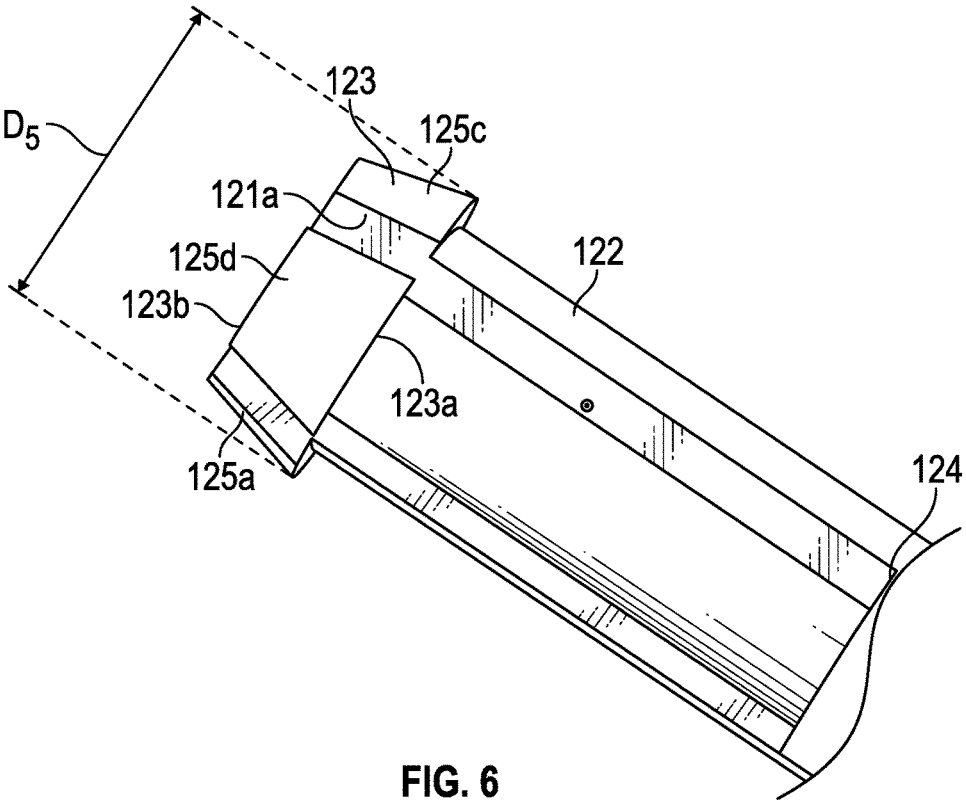
FIG. 6 is an enlarged view of the circled portion of the lock pin shown in FIG. 4.

The pin lock receptacles 114 are sized to receive pin locks 120, a preferred example of which is shown in FIGS. 4-6, with a compressible slotted section 122 having a crown section 123, a cylindrical extension section 124 having a third diameter $D_3$ smaller than the first and second diameters, and a foundation section 126 having a fourth diameter $D_4$ that is greater than the first, second, and third diameters. The compressible slotted section 122 preferably comprises two slots 121*a*, 121*b* extending perpendicular to one another and dividing up the slotted section 122 and crown section 123 into four prongs 125*a*, 125*b*, 125*c*, 125*d*. In an alternative embodiment, there may be four or six slots dividing the slotted section 122 and the crown section 123 into a greater number of prongs. The crown section 123 tapers, i.e., decreases, in diameter from its lowest edge 123*a* to its highest edge 123*b*, but its greatest diameter $D_5$ is greater than that of the extension section 124 and of the lower bore 114*b*.

Figure 7:
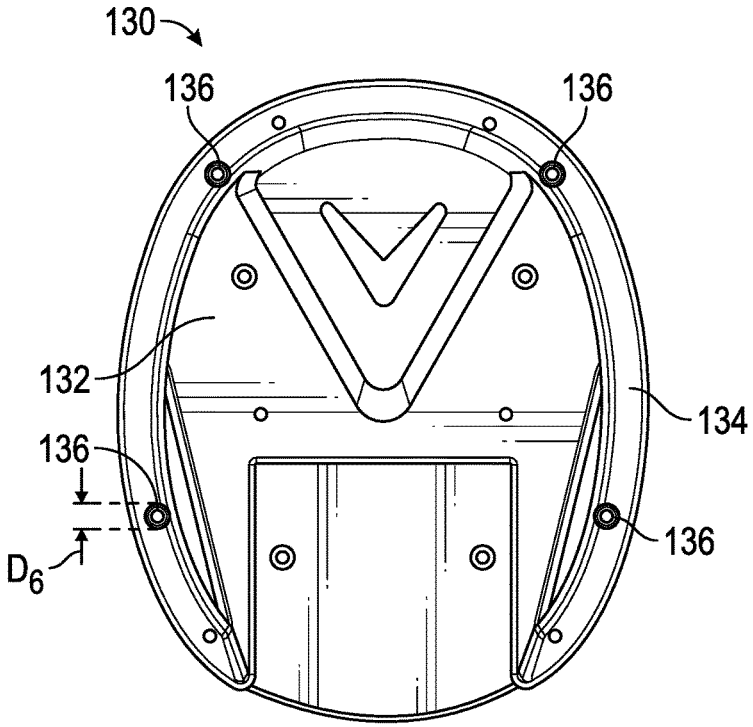
FIG. 7 is a bottom, plan view of the golf bag base of the present invention.
Figure 8:
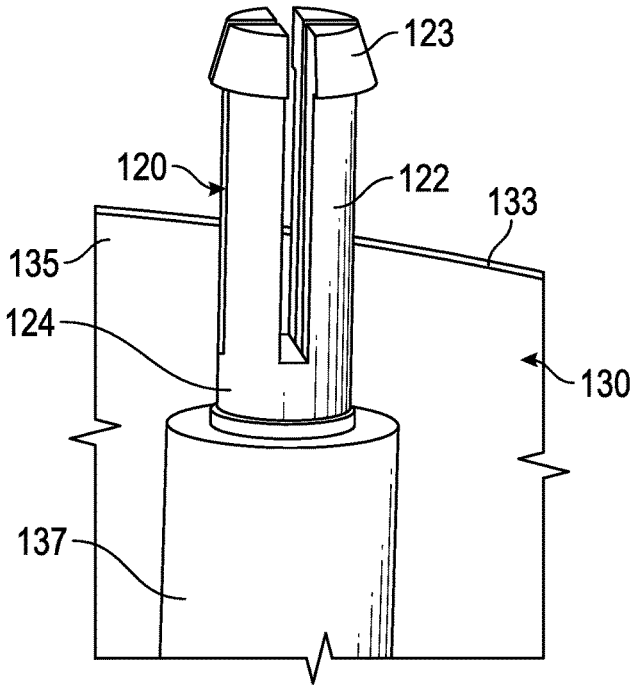
FIG. 8 is a side elevation view of the lock pin shown in FIG. 4 engaged with a pin through hole shown in FIG. 7.
Figure 10:
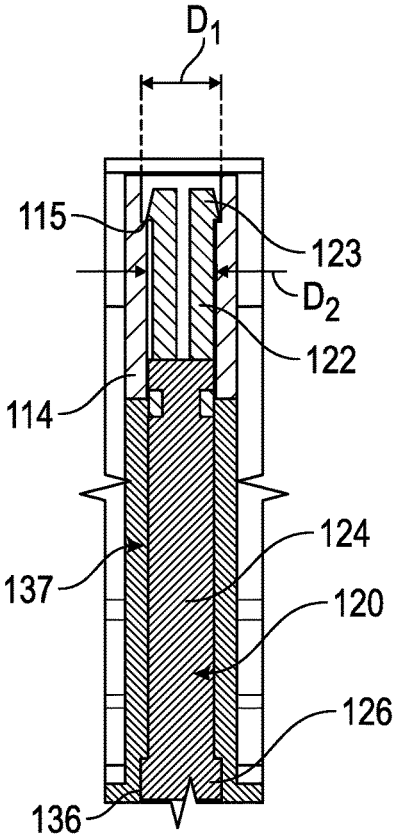
FIG. 10 is a cross-sectional view of the assembly shown in FIG. 9 along lines 10-10.

The base assembly 100 of the present invention also includes a bag base 130, shown in FIG. 7, which has a base surface 132, an edge region 134 at the outer edge of the base surface 132, a side wall 135, and a plurality of pin holes 136 extending through the edge region 134. The pin holes 136 preferably are encircled by cylindrical bodies 137 that extend upwards from the base surface 132 and are long enough to cover more than 50% of the extension sections 124 of the pin locks 120 when the pin locks 120 are engaged with the pin holes 136, as illustrated in FIGS. 8 and 10. Preferably, the bodies 137 cover more than 75% of the extension sections 124. The pin holes 136 have a consistent diameter $D_6$ that is larger than that of the extension section 124 but smaller than that of the foundation section 126. Each pin lock 120 is inserted, crown section 123 first, into a pin hole 136 via the base surface 132. The taper on the crown section 123 causes the slotted section 122 to compress inwards, thus allowing the slotted section 122 to pass through the pin holes 136. The foundation section 126 is too wide to pass through the pin holes 136, and thus retains the pin locks 120 in the pin holes 136.

Figure 9:
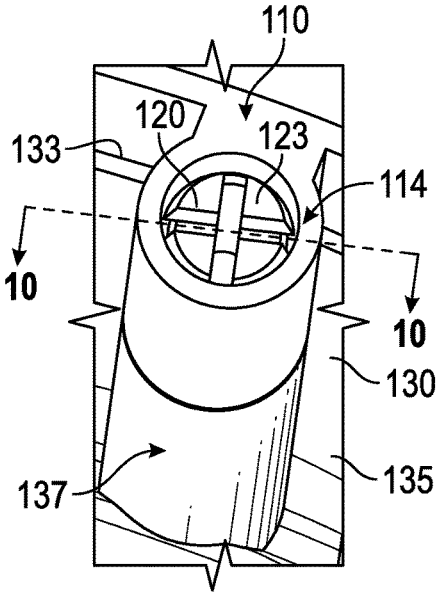
FIG. 9 is a top, perspective view of the pin receptacle shown in FIG. 3 engaged with the lock pin and pin through hole shown in FIG. 8.

Once the pin locks 120 are secured within the pin holes 136, they are captured there by the retainer ring 110, as shown in FIGS. 9 and 10. The retainer ring 110 is placed on the upper edge 133 of the side wall 135 of the bag base 130 so that the pin lock receptacles 114 line up with the cylindrical pin hole bodies 137. The compressible slotted section 122 of each pin lock 120 is compressed as it enters the lower bore 114*b* of a pin lock receptacle, but the crown section 123 expands once it enters the upper bore 114*a* such that its lowest edge 123*a* rests against the shelf 115 created by the upper and lower bores 114*a*, 114*b*, and prevents the pin lock 120 from being dislodged from the pin lock receptacle 114.

The retainer ring 110 preferably is first assembled with other elements of the golf bag 10, including the body 40 and the top collar 20, before being affixed to the bag base 130. The bag base 130 is easily snapped onto the retainer ring 110 once pin locks 120 are disposed within all of the available pin holes 136, and the pin locks 120 prevent the bag base 130 from being removed due to the structural features described herein. The snapping sound made by the pin locks 120 when they engage the retainer ring 110 provides audible confirmation to an assembler that the base assembly 100 has been properly assembled, and that it cannot be readily disassembled by a golfer.

Each of the parts of the base assembly 100 disclosed herein is preferably made from one or more structurally sound, lightweight materials, including but not limited to plastic, composite, and low density metal alloy. The stays, top collar 20, and dividers 30 may also be made of this material, while the body 40 is preferably made from a fabric material.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf bag comprising:

a body comprising a ring with a plurality of pin receptacles, each of the plurality of pin receptacles having a first bore and a second bore wherein a diameter of the second bore is larger than a diameter of the first bore;

a base comprising a plurality of pin through holes; and a plurality of locking pins, each of the plurality of locking pins comprising a foundation section having a first diameter, an extension section having a second diameter, a slotted section having a third diameter, and a crown section having a fourth diameter, wherein the slotted section is compressible, wherein the first diameter is greater than the second diameter, wherein the second diameter is greater than the third diameter, wherein the fourth diameter is greater than the third diameter, wherein the first diameter is larger than a diameter of the plurality of pin through holes, wherein each of the plurality of locking pins is positioned through a corresponding pin through hole and a corresponding pin receptacle, wherein the slotted section of each of the plurality of locking pins expands once positioned within the corresponding pin receptacle to lock each of the plurality of locking pins in place and secure the base to the body.

2. The golf bag of claim 1, wherein the ring comprises a plurality of stay receptacles.

3. The golf bag of claim 1, wherein the plurality of locking pins ranges from two to ten.

4. The golf bag of claim 1, wherein each of the plurality of locking pins has from two to six slots in the slotted section.

5. The golf bag of claim 1, wherein each of the plurality of locking pins has a length ranging from two inches to six inches.

6. The golf bag of claim 1, wherein the first diameter ranges from 0.1 inch to 0.5 inch.

7. The golf bag of claim 1, wherein each of the plurality of pin through holes comprises a cylindrical body.

8. The golf bag of claim 7, wherein each cylindrical body covers more than 50% of the extension section when a locking pin is engaged with the cylindrical body.

9. The golf bag of claim 8, wherein each cylindrical body covers more than 75% of the extension section when a locking pin is engaged with the cylindrical body.

10. The golf bag of claim 1, wherein the fourth diameter is the diameter of the crown section at a lowest edge, wherein the crown section comprises a fifth diameter at an upper edge of the crown section, and wherein the fourth diameter is greater than the fifth diameter.

11. The golf bag of claim 10, wherein the crown section decreases gradually in diameter from the fourth diameter to the fifth diameter.

12. The golf bag of claim 1, further comprising a top collar and a plurality of stays, wherein the ring comprises a plurality of stay receptacles, wherein each stay comprises a first end and a second end, wherein each of the plurality of stay receptacles is engaged with a first end, and wherein the top collar engages each second end.

13. The golf bag of claim 12, wherein each of the plurality of stays is permanently engaged with each of the top collar and the ring.

14. The golf bag of claim 12, wherein none of the plurality of stays makes contact with the base.

15. A golf bag base assembly comprising:

a ring comprising a plurality of pin receptacles and a plurality of stay receptacles, each of the plurality of pin receptacles having a first bore and a second bore, wherein a diameter of the second bore is larger than a diameter of the first bore;

a base comprising a base surface, a side wall, and a plurality of pin through holes; and a plurality of locking pins, each locking pin comprising a foundation section, an extension section, a compressible slotted section, and a tapered crown section, wherein each of the plurality of pin through holes extends through the base surface and comprises a cylindrical body, wherein each of the plurality of locking pins is positioned through a corresponding pin through hole and a corresponding pin receptacle, wherein the slotted section of each of the plurality of locking pins expands once positioned within the corresponding pin receptacle to lock each of the plurality of locking pins in place and secure the base to the ring, and wherein each cylindrical body covers more than 50% of the extension section when a locking pin is engaged with the corresponding cylindrical body.

16. The golf bag base assembly of claim 15, wherein each cylindrical body covers more than 75% of the extension section when a locking pin is engaged with the corresponding cylindrical body.

17. The golf bag base assembly of claim 15, wherein the base surface comprises an edge region proximate the side wall, and wherein each of the plurality of pin through holes is located in the edge region.

18. The golf bag base assembly of claim 15, wherein the compressible slotted section of each locking pin comprises at least two slots and at least four prongs.

19. The golf bag base assembly of claim 15, wherein the plurality of locking pins ranges from two to ten.

20. The golf bag base assembly of claim 15, wherein each of the plurality of locking pins has a length ranging from two inches to six inches.

* * * * *